United States Patent [19]

Kiyota et al.

[11] 4,200,461

[45] Apr. 29, 1980

[54] XANTHENE TYPE ACID DYE AND A BASE DYE-SENSITIZED ZINC OXIDE PHOTOCONDUCTIVE ELEMENT

[75] Inventors: Kohei Kiyota, Machida; Hiroo Ueda, Tokyo; Shunji Kitagawa, Yokohama; Kunihiko Tasai, Kawasaki, all of Japan

[73] Assignee: Fujitsu Limited, Japan

[21] Appl. No.: 801,723

[22] Filed: May 31, 1977

[30] Foreign Application Priority Data

Jun. 9, 1976 [JP] Japan ..... 51-67949
Jul. 1, 1976 [JP] Japan ..... 51-78608

[51] Int. Cl.[2] ..... G03G 5/09
[52] U.S. Cl. ..... 430/91; 430/72
[58] Field of Search ..... 96/1.7, 1.8, 1.6

[56] References Cited

U.S. PATENT DOCUMENTS

| | | | |
|---|---|---|---|
| 3,051,569 | 8/1962 | Sugarman et al. | 96/1.7 |
| 3,052,540 | 9/1962 | Greig | 96/1.7 |
| 3,403,023 | 9/1968 | Carrington et al. | 96/1.7 |

*Primary Examiner*—Roland E. Martin, Jr.
*Assistant Examiner*—John L. Goodrow
*Attorney, Agent, or Firm*—Staas & Halsey

[57] ABSTRACT

Disclosed is a photoconductive recording element having a high photosensitivity over the entire band of visible rays which comprises an electroconductive substrate and a photoconductive layer formed on the substrate. The photoconductive layer comprises an acid dye and a basic dye both of which may be concurrently adsorbed on the outer surfaces of fine zinc oxide particles, or the acid dye of which is adsorbed on the outer surfaces of the zinc oxide particles and the basic dye of which is adsorbed on each layer of the acid dye.

6 Claims, 7 Drawing Figures

XANTHENE TYPE ACID DYE AND A BASE DYE-SENSITIZED ZINC OXIDE PHOTOCONDUCTIVE ELEMENT

The present invention relates to a photoconductive recording element. More particularly, the present invention relates to a photoconductive recording element having an enhanced photosensitivity at a relatively large wave length of 600 to 700 mμ of visible rays.

Recently, the so-called laser printing apparatus has been developed. In this apparatus, a photoconductive sheet is used as a recording element. The photoconductive recording element has a substrate composed of a electroconductive material and a photoconductive layer supported on the substrate and comprising fine particles of zinc oxide. In the operation of the laser printing apparatus, the photoconductive layer is electrostatically charged, the charged photoconductive layer is subjected to a scanning operation with laser beams so as to form a desired pattern of latent images on the photoconductive layer, the latent images are developed into visible images and, then, the visible images are transferred onto a surface of a recording sheet. In the conventional type of photoconductive recording element, the photoconductive layer contains fine zinc oxide particles on which an acid dye, for example, Rose Bengale or Erithrosine B, is carried as a photosensitizing agent. For example, when the Rose Bengale is carried on the fine zinc oxide particles, the resultant photoconductive layer has a maximum sensitivity at a wave length of about 560 mμ of visible rays. However, this conventional type of photoconductive layer has an extremely poor sensitivity at a relatively large wave length of 600 to 700 mμ of visible rays. In the typical type of laser printing apparatus, He—Ne laser beams having a main wave length of 632.8 mμ are used for forming the latent images on the charged photoconductive layer. However, the above-mentioned photoconductive layer has a poor sensitivity to the He—Ne laser beams. Under these circumstances, an attempt was made to utilize Malachite Green, which has a high sensitivity at a wave length of 600 to 700 mμ of visible rays, in place of the Rose Bengale. In this attempt, it was observed that the photosensitivity of the Malachite Green-containing photoconductive layer is higher at a wave length of about 640 mμ than that of the conventional photocontactive layer containing Rose Bengale. However, the photosensitivity of the photoconductive layer consisting of the zinc oxide particles carrying thereon the Malachite Green only is very low, at a wave length of 634 mμ, that is, 0.1 or less.

In order to be practically usable in a commercial photoconductive recording element, the photoconductive layer is required to have a photosensitivity of at least 1.0 at the wave-length of visible rays used in the recording operation. Accordingly, the photoconductive layer containing Malachite Green, but not acid dye, does not have sufficient photosensitivity to the He—Ne laser beams.

The "photosensitivity" used herein is represented by a reciprocal number of the value of the half decay time in seconds in which the initial value of charge on the photoconductive layer decreases to one half the initial value.

An object of the present invention is to provide a photoconductive recording element highly sensitive to a relatively large wave length of visible rays.

Another object of the present invention is to provide a photoconductive recording element capable of recording with laser beams.

The above objects can be attained by the photosensitive recording element of the present invention which comprises an electroconductive substrate, and a photoconductive layer supported on the electroconductive substrate and comprising fine particles of zinc oxide having at least one acid dye and at least one basic dye both adsorbed on the outer surface of the zinc oxide particles.

The feature and advantages of the present invention will be illustrated by the following description with reference to the accompanying drawings, in which.

In the photoconductive recording element of the present invention, the acid dye is selected from xanthene type acid dyes, for example, Rose Bengale (C.I. 45440), Phloxine (C.I. 45410), Erythrosive B (C.I. 45430) and Eosin (C.I. 45400). These dyes are effective to sensitize the zinc oxide particles to a wave length of about 550 to 600 mμ of visible rays. Also, in the photoconductive recording element of the present invention, the basic dye may be selected from Triphenylmethane type basic dyes, for example, Malachite Green (C.I. 42000), Crystal Violet (C.I. 42555), Brilliant Green (C.I. 42040).

Surprisingly, it was discovered by the inventors of the present invention that the photoconductive layer containing both the acid dye and the basic dye has a very high photosensitivity which could be expected neither from the photoconductive layer containing the acid dye alone nor the photoconductive layer containing the basic dye alone. This feature of the photoconductive layer of the present invention will be illustrated by the following description with reference to FIG. 1 of the drawings.

Figure 1:
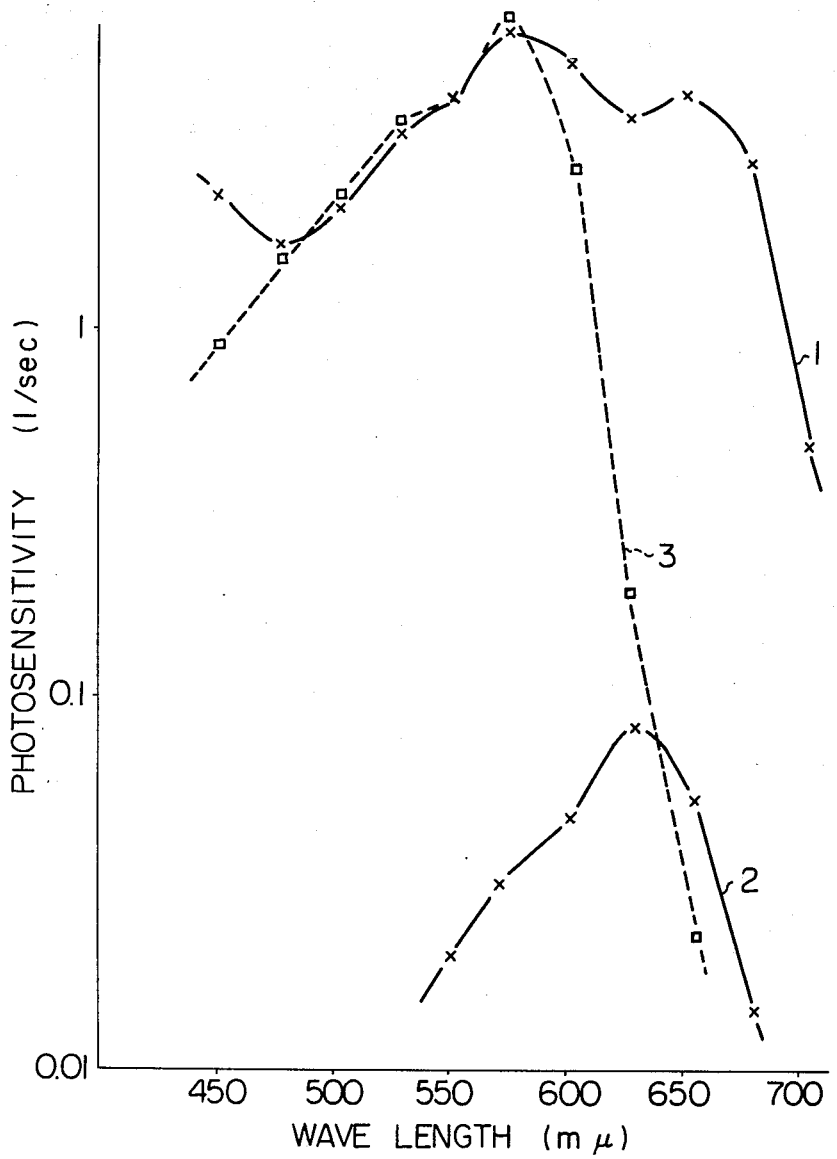
FIG. 1 is a graph showing the photosensitivities of a photoconductive layer of the present invention and conventional photoconductive layers in a range of wave lengths from 450 to 700 mμ.

A first photoconductive layer was formed on an aluminium foil having a thickness of 9μ by means of the following method. 30 g of finely divided zinc oxide and 20 g of an acrylic resin binder were uniformly dispersed in 30 g of toluene, and then, 140 mg of Rose Bengale and 40 mg of Malachite Green were added to the dispersion. After milling for 6 hours, the mixture was applied onto the surface of the aluminium foil to form a photoconductive layer having a thickness of 30 mμ, dried in the atmosphere, and heated in a drier, at a temperature of 80° C., for about 20 minutes, to completely evaporate the solvent from the photoconductive layer. The photoconductive layer was subjected to a determination of the photosensitivity thereof at a wave length of 450 to 700 mμ. In FIG. 1, Curve 1 shows the relationship of the photosensitivity of the above-produced first photoconductive layer to the wave length of visible rays. For comparison, a second photoconductive layer was prepared in the same manner as mentioned above, using no Rose Bengale. The photosensitivity of the second photoconductive layer is shown by Curve 2. A third photoconductive layer was prepared in the same manner as the first photoconductive layer mentioned above, except that no Malachite Green was used. The photosensitivity of the third photoconductive layer is shown by Curve 3. From the comparison of Curve 1 with Curves 2 and 3, it is obvious that the photosensitivity of the photoconductive layer containing both Rose Bengale and Malachite Green at a wave length of 630 to 700 mμ of visible rays is remarkably larger than the sum of the photosensitivities of the photoconductive layers respectively containing Rose Bengale alone and Malachite Green alone.

Figure 2:
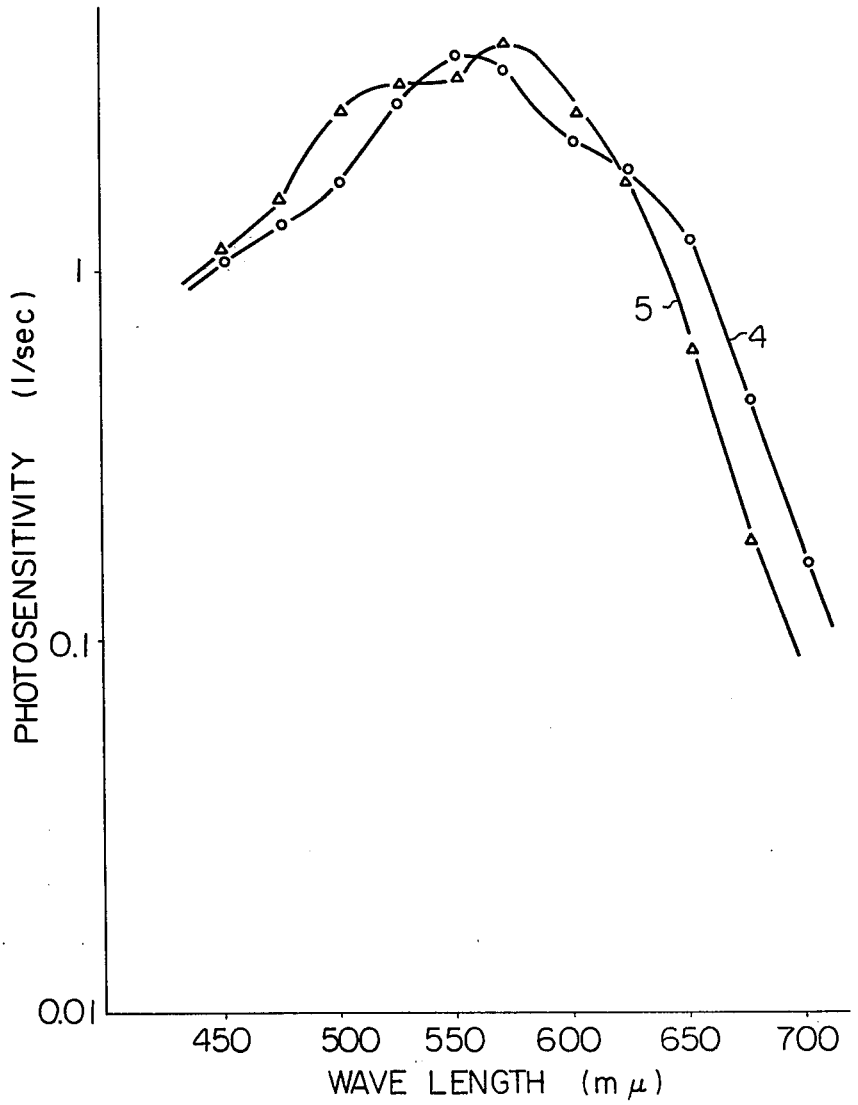
FIG. 2 is a graph showing the photosensitivities of two different types of photoconductive layers of the present invention.

In FIG. 2, Curve 4 shows the photosensitivity of a photoconductive layer prepared from 30 g of finely divided zinc oxide, 120 mg of Rose Bengale and 30 mg of Brilliant Green. Also in FIG. 2, Curve 5 shows the photosensitivity of another photoconductive layer prepared from 30 g of finely divided zinc oxide, 120 mg of Rose Bengale and 30 mg of Crystal Violet. FIG. 2 shows that the photoconductive layers of the present invention have an extremely high photosensitivity to a relatively large wave length of 600 to 700 mμ of visible rays.

In another example, 30 g of finely divided zinc oxide and 20 g of an acrylic resin binder were dispersed in 30 g of toluene, and then 100 mg of Erythrosine and 50 mg of Rhodamine B, which were dissolved in 10 ml of ethyl alcohol, were added to the above-prepared dispersion. The resultant dispersion was milled for 6 hours. The resultant dispersion was applied onto an aluminium foil, naturally dried in the atmosphere, and heated at a temperature of 80° C. for 20 minutes so as to remove the solvent and leave a photoconductive layer on the aluminium foil. The photoconductive layer thus prepared had an enhanced photosensitivity to a relatively large wave length of visible rays.

Figure 3:
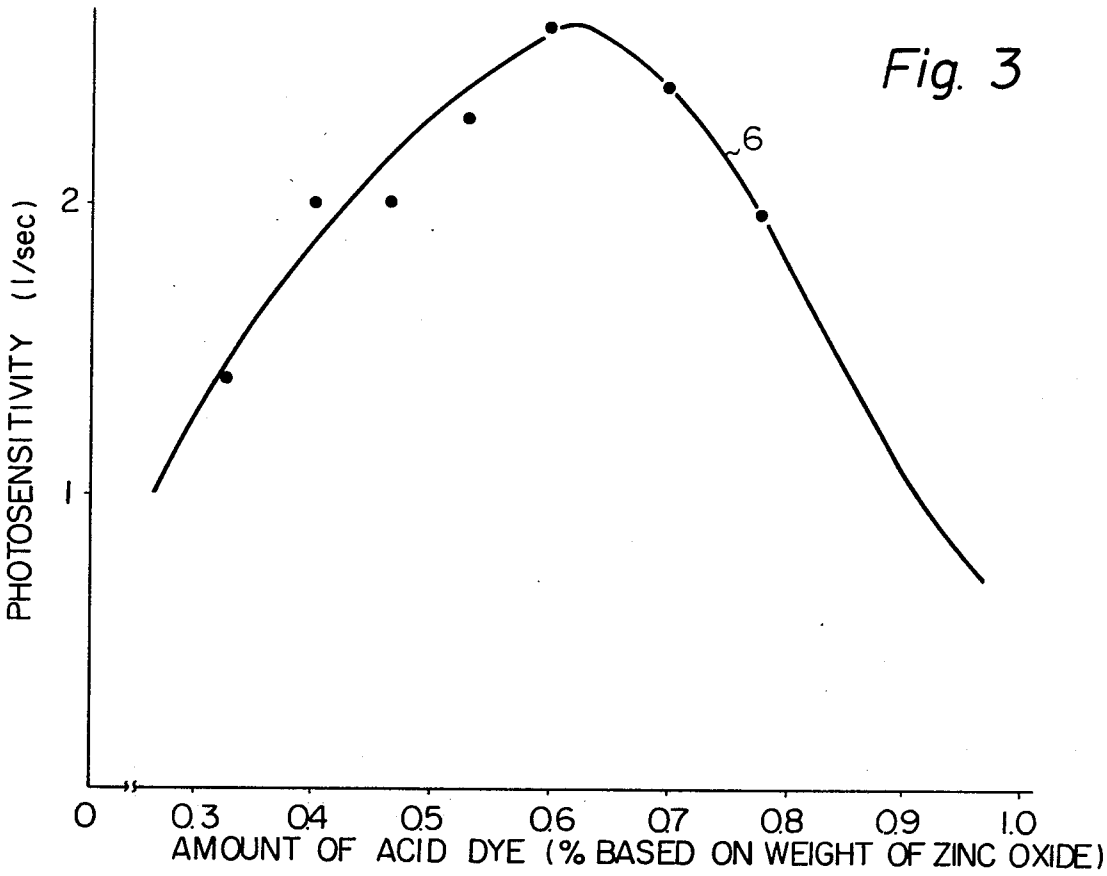
FIG. 3 is a graph showing a relationship of the photoconductive layer of the present invention to amounts of acid dye incorporated to the photoconductive layer.

In the photoconductive layer of the present invention, it is preferable that the amount of the acid dye to be adsorbed on the zinc oxide particle surfaces is in a range from 0.3 to 0.9% based on the weight of the zinc oxide particles. For example, seven types of photoconductive layers were produced, each on an aluminium foil, using finely divided zinc oxide and Crystal Violet in an amount of 0.067% based on the weight of the zinc oxide, and Rose Bengale in an amount of 0.2 to 1.0% based on the weight of the zinc oxide. The relationship between the photosensitivity of the above-prepared photoconductive layers and the amount of Rose Bengale is shown in Curve 6 in FIG. 3. The above photosensitivity was determined at a charge voltage of 250 volts, using laser beams having a wave length of 632.8 mμ with a power of 0.67 $\mu W/cm^2$. From FIG. 3, it is obvious that the amount of the acid dye to be incorporated onto the zinc oxide particles is preferably in the range from 0.3 to 0.9% based on the weight of the zinc oxide particles.

Figure 4:
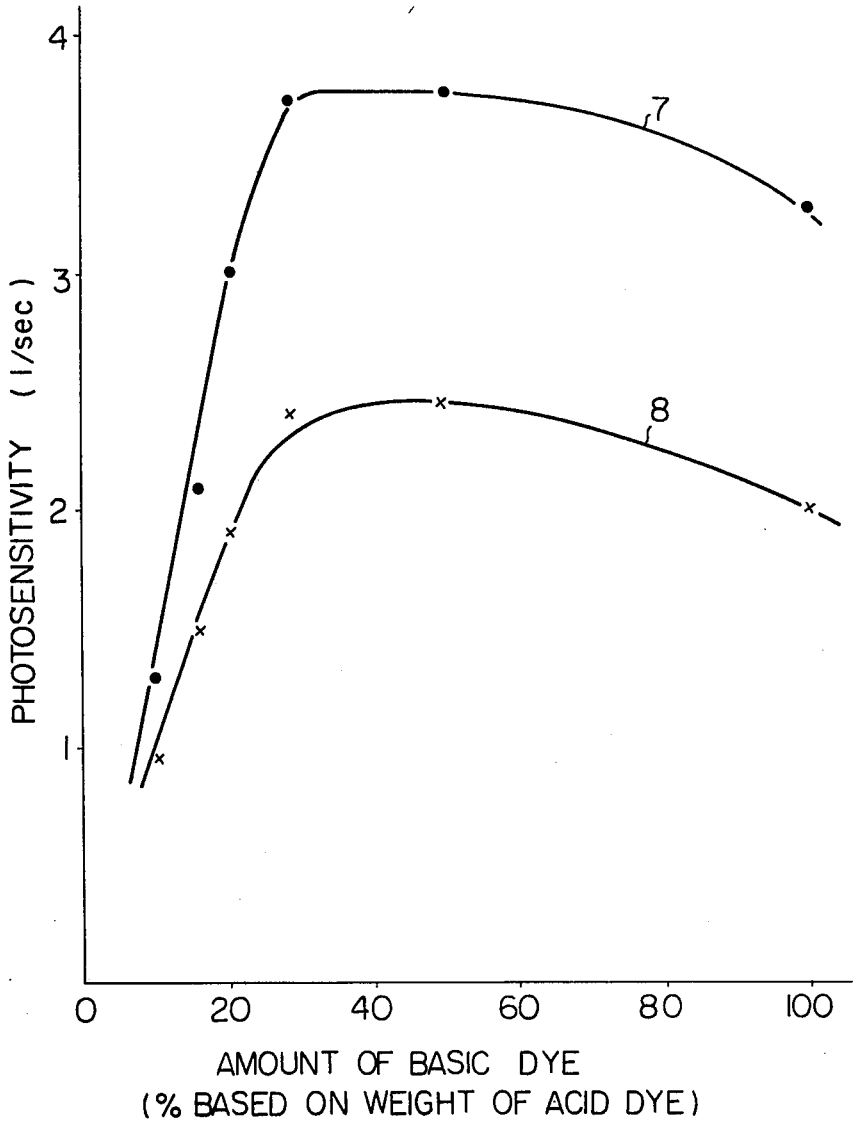
FIG. 4 is a graph showing the relationships of two different types of photoconductive layers of the present invention to the amount of basic dye incorporated to each of the photoconductive layers.

In the photoconductive layer of the present invention, it is preferable that the amount of the basic dye to be incorporated onto the zinc oxide particles is 10% or more based on the weight of the acid dye to be concurrently incorporated onto the zinc oxide particles. This feature will be illustrated with reference to FIG. 4 of the drawings. In FIG. 4, Curve 7 shows a relationship between the photosensitivity of a photoconductive layer consisting of zinc oxide particles, Rose Bengale in an amount of 0.53% based on the weight of the zinc oxide particle and Crystal Violet in an amount of 10 to 100% based on the weight of Rose Bengale, and the amount of the Crystal Violet used. Curve 8 in FIG. 4 shows the relationship between the photosensitivity of the same photoconductive layer as mentioned above, except that Brilliant Green was used in place of Crystal Violet, and the amount of the Brilliant Green used. The determination of the photosensitivity of the photoconductive layers in FIG. 4 was carried out using the same method as used in FIG. 3. FIG. 4 shows that it is preferable to use the basic dye in an amount of 10% or more, more preferably, 30 to 80%, based on the weight of the acid dye to be incorporated onto the zinc oxide particles concurrently with the basic dye.

In the preparation of the photoconductive layer of the present invention, a mixture of the acid dye and the basic dye may be applied onto the zinc oxide particles, so as to allow the basic dye to be adsorbed concurrently with the acid dye on the outer surfaces of the zinc oxide particles. Surprisingly, it was discovered by the inventors of the present invention that when the acid dye is adsorbed on the outer surface of the zinc oxide particles and, thereafter, the basic dye is adsorbed on the acid dye-adsorbing outer surfaces of the zinc oxide particles, the resultant photoconductive layer has an excellent photosensitivity at a wave length of 600 to 700 mμ of visible rays. This excellent photosensitivity could not be anticipated from the afore-mentioned photoconductive layer having the zinc oxide particles to which the acid dye and the basic dye are concurrently adsorbed.

Figure 5:
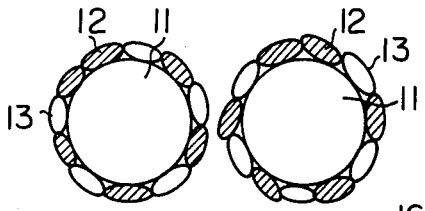
FIG. 5 is a model view of zinc oxide particles randomly carrying thereon acid and basic dye particles.

FIG. 5 of the drawings is a model view of particles 11 of zinc oxide, having a diameter of 0.1 to 0.5μ, onto which acid dye particles 12 and basic dye particles 13 are concurrently adsorbed. Generally, it is known that the zinc oxide is an n-type of semi-conductor material, the acid dye is a p-type of semi-conductor coloring material and the basic dye is an n-type of semi-conductor coloring material. Accordingly, when the n-type basic dye is directly adsorbed on the outer surface of the zinc oxide particle, the surface level of the zinc oxide particle is reduced and the activity of oxygen ions, being adsorbed on the outer surface of the zinc oxide particle and functioning as accepters of charge, is reduced by the basic dye.

Figure 6:
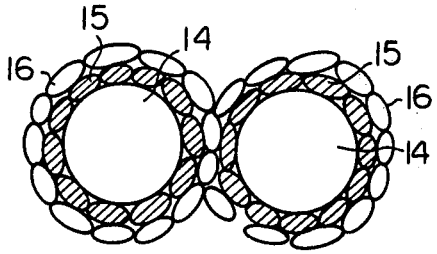
FIG. 6 is a model view of another type of zinc oxide particles each carrying thereon a layer of acid dye particles formed on the outer surface of the zinc oxide particle and a layer of basic dye particles formed on the acid dye particle layer.

FIG. 6 is a model view of particles 14 of zinc oxide carrying a layer of acid dye particles 15 directly formed on the outer surfaces of the zinc oxide particles 14 and a layer of basic dye particles 16 formed on the acid dye particle layer 15. The zinc oxide particles carrying thereon the acid dye particles and the basic dye particles in the manner of FIG. 6 result in the formation of a photoconductive layer having an extremely high photosensitivity at a relatively large wave length of visible rays. This feature could not be expected from the zinc oxide particles of FIG. 5, or from zinc oxide particles having basic dye particles directly adsorbed on their surfaces; and then having acid dye particles adsorbed on the basic dye particle layer.

For example, Table 1, below, shows the photosensitivities of three different types of photoconductive layers A, B and C. The photoconductive layer C was prepared by the following method. 30 g of finely divided zinc oxide and 20 g of an acrylic resin binder were uniformly dispersed in 30 g of xylene by milling the mixture for about 30 minutes. 100 mg of Rose Bengale dissolved in 10 ml of ethyl alcohol were added to the dispersion while continuing the milling for 2 hours, so as to allow the Rose Bengale particles to be adsorbed on the outer surfaces of the zinc oxide particles. Then, 7 mg of Malachite Green dissolved in 10 ml of ethyl alcohol were added to the above dispersion, while continuing the milling for further 3 hours, so as to allow the Malachite Green particles to form a layer on the Rose Bengale particle layer. The resulting dispersion was applied onto a surface of an aluminium foil, by using a bar coator, to form a photoconductive layer having a thickness of 30μ. The photoconductive layer was dried naturally in the atmosphere, and then heated at a temperature of 80° C. for 20 minutes to completely remove the solvent from the layer.

The photoconductive layer A was prepared using the same process as used for the photoconductive layer C, except that no Malachite Green was added to the dispersion of zinc oxide. Also, the photoconductive layer B was prepared using the same process as used in the preparation of the photoconductive layer C, except that the Rose Bengale and the Malachite Green were added concurrently to the zinc oxide dispersion.

Each surface of the photoconductive layers A, B and C were uniformly corona charged at a voltage of −9 KV to generate a potential of 300 volts. Thereafter, each of the surfaces were exposed to laser beams having a wave length of 632.8 mμ. The half decay time, in which the initial surface potential of the photoconductive layer decreased to one half the initial value, was measured. The direction of the laser beams was effected with an energy of 0.67 $\mu W/cm^2$. The results are indicated in Table 1.

Table 1

| Photoconductive Layer | Photosensitivity (1/sec) |
|---|---|
| A | 0.03 |
| B | 0.12 |
| C | 0.34 |

Figure 7:
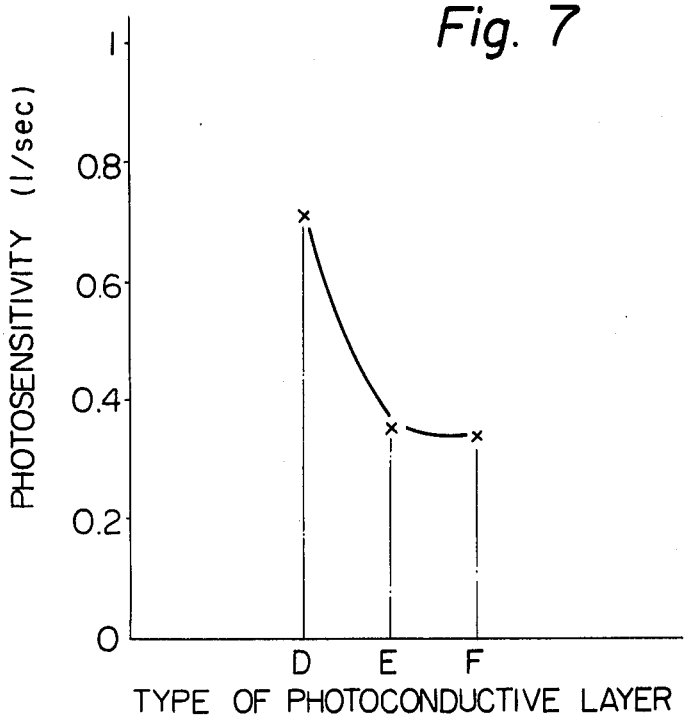
FIG. 7 shows the photosensitivities of three different types of photoconductive layers of the present invention.

Table 1 shows that the photoconductive layers B and C of the present invention each had a much higher photosensitivity to the visible rays having a wave length of 632.8 mμ than that of the old type of photoconductive layer A. Table 1 also shows that the photosensitivity of the photoconductive layer C, in which the basic dye particle layer was formed on the acid dye particle layer, was much higher than that of the photoconductive layer B, in which the basic and acid dye particles were randomly adsorbed on the zinc oxide particle surfaces. The feature of the photoconductive layers of the present invention just mentioned above will be further illustrated with reference to FIG. 7 of the drawings. FIG. 7 shows the photosensitivities of photoconductive layers D, E and F. The photoconductive layer D was prepared by applying 100 mg of Rose Bengale to 30 g of zinc oxide particles and, thereafter, applying 10 mg of Crystal Violet to the Rose Bengale-adsorbing zinc oxide particles. The photoconductive layer E was prepared by applying 10 mg of Crystal Violet to 30 g of zinc oxide particles, and then applying, 100 mg of Rose Bengale to the Crystal Violet-adsorbing zinc oxide particles. The photoconductive layer F was produced in such a manner that 100 mg of Rose Bengale and 10 mg of Crystal Violet were concurrently applied to 30 g of zinc oxide particles. Each surface of the above-prepared photoconductive layers was charged to generate a potential of 250 volts, and then exposed to laser beams having a wave length of 632.8 mμ directed at an energy of 0.59 $\mu W/cm^2$. The decay time, in which the potential of 250 volts was reduced to 125 volts, was measured to determine the photosensitivity.

FIG. 7 shows that, in spite of the fact that the photosensitivity of the photoconductive layer E is similar to that of the photoconductive layer F, the photoconductive layer D has a remarkably higher photosensitivity than that of the photoconductive layers E and F. From the above-mentioned facts, it is evident that, in order to obtain a very high photosensitivity, it is important that the layer of the acid dye particles, which is a p-type of semi-conductor material, be interposed between the outer surface of the zinc oxide particles and the layer of the basic dye particles, both of which are n-type semiconductor materials.

The photoconductive recording element may be produced by the following process. A dispersion is prepared by uniformly dispersing fine particles of zinc oxide having a diameter of 0.1 to 0.5 microns per particle in an organic solvent, for example, aromatic hydrocarbon, such as toluene and xylene, while milling the mixture for 30 to 60 minutes. An acid dye preferably dissolved in an organic solvent, for example, methyl alcohol, ethyl alcohol, and isopropyl alcohol, is added to the above-prepared dispersion and the mixture is milled for 1 to 5 hours so as to allow the acid dye particles to form a layer thereof on the outer surface of the zinc oxide particles. Thereafter, a basic dye is preferably dissolved in an organic solvent, such as methyl alcohol, ethyl alcohol and isopropyl alcohol, and is admixed to the above mixture. The admixture is, then, milled for 1 to 5 hours so as to allow the basic dye particles to form a layer on the layer of the acid dye particles. The resultant admixture is applied on a surface of an electroconductive substrate consisting of, for example, electroconductive paper or metal foil, such as aluminium foil, so as to form a coating film of the admixture. The application of the admixture may be carried out by any coating method, for example, the doctor coating, spraying, brush coating and roller coating methods. The coating film of the admixture preferably has a thickness of 10 to 50 microns, more preferably 20 to 30 microns. The coating film is dried naturally in the atmosphere, and then is heated at temperature of 60° to 100° C. to completely remove the solvent used to form a photoconductive layer.

The photoconductive recording element has a photoconductive layer having excellent photosensitivity over the entire band of visible rays including a relatively large wave length of 600 to 700 mμ, for example, 632.8 mμ, of visible rays. Accordingly, the photoconductive recording element can be recorded on by the laser printing apparatus using any wave length of visible rays, for example, laser beams having a wave length of 632.8 mμ, at a high speed.

What we claim is:

1. A dye-sensitized zinc oxide photoconductive element having an enhanced photosensitivity over the entire band of visible rays, comprising an electroconductive substrate and a photoconductive layer supported on said substrate and comprising fine particles of zinc oxide having at least one xanthene type acid dye and at least one basic dye, said acid dye being adsorbed in an amount of from 0.3 to 0.9%, based on the weight of said zinc oxide particles, on the outer surface of said zinc oxide particles and said basic dye being adsorbed in an amount of 10% or more, based on the weight of said acid dye, on the layer of said acid dye.

2. A photoconductive recording element as claimed in claim 1, wherein said basic dye is selected from triphenylmethane type basic dyes.

3. A photoconductive recording element as claimed in claim 2, wherein the amount of said basic dye is 15 to 100% based on the weight of said acid dye.

4. A photoconductive element as claimed in claim 1, wherein said acid dye is selected from Rose Bengale, Phloxine, Erythrosine B and Eosine.

5. A photoconductive recording element as claimed in claim 1, wherein said basic dye is selected from Malachite Green, Crystal Violet, and Brilliant Green.

6. A photoconductive recording element as claimed in claim 1, wherein said zinc oxide particles have a diameter of 0.1 to 0.5 microns per particle.

* * * * *

UNITED STATES PATENT AND TRADEMARK OFFICE

CERTIFICATE OF CORRECTION

PATENT NO. : 4,200,461

DATED : April 29, 1980

INVENTOR(S) : Kohei Kiyota et al.

It is certified that error appears in the above-identified patent and that said Letters Patent are hereby corrected as shown below:

"wave length" should be "wavelength" at the following occurrences:

Column 1, lines 10,31,32,34,35,37,43,47,52,56,68.

Column 2, lines 18,44.

Column 3, lines 6, 9, 21, 36, 50, 65.

Column 4, lines 38, 65.

Column 5, lines 37, 52.

Column 6, lines 10, 62, 65, 66.

Column 4, lines 47-50, "semi-conductor" should be --semiconductor--.

Column 5, line 19, "aluminium" should be --aluminum--.

Column 6, line 49, "aluminium" should be --aluminum--.

Signed and Sealed this

*Twelfth* Day of *August 1980*

[SEAL]

*Attest:*

SIDNEY A. DIAMOND

*Attesting Officer*

*Commissioner of Patents and Trademarks*